US011415031B2

(12) United States Patent
Vanleene

(10) Patent No.: US 11,415,031 B2
(45) Date of Patent: Aug. 16, 2022

(54) METHOD FOR FORMING A COLLAR IN A MUFFLER HOUSING

(71) Applicant: Bosal Emission Control Systems NV, Lummen (BE)

(72) Inventor: Paul Vanleene, Westerlo (BE)

(73) Assignee: Bosal Emission Control Systems NV, Lummen (BE)

( * ) Notice: Subject to any disclaimer, the term of this patent is extended or adjusted under 35 U.S.C. 154(b) by 1062 days.

(21) Appl. No.: 16/040,913

(22) Filed: Jul. 20, 2018

(65) Prior Publication Data

US 2019/0024549 A1 Jan. 24, 2019

(30) Foreign Application Priority Data

Jul. 21, 2017 (EP) ..... 17182504

(51) Int. Cl.
*F01N 1/08* (2006.01)
*B21B 17/02* (2006.01)
(Continued)

(52) U.S. Cl.
CPC ..... *F01N 1/083* (2013.01); *B21B 17/02* (2013.01); *B21D 19/02* (2013.01); *B21D 19/088* (2013.01);
(Continued)

(58) Field of Classification Search
CPC ..... B21C 37/292; F01N 1/083; B21B 17/02; B21D 53/88
See application file for complete search history.

(56) References Cited

U.S. PATENT DOCUMENTS 3,468,147 A * 9/1969 Davies ..... F16L 47/28 72/370.27
3,884,060 A 5/1975 Larikka
(Continued)

FOREIGN PATENT DOCUMENTS

AU 2003295055 A1 6/2004
CA 2469438 A1 4/2005
(Continued)

OTHER PUBLICATIONS

Office Action for Chinese Patent Application No. 201810784801.X (dated May 24, 2021).
(Continued)

*Primary Examiner* — Jeremy A Luks
(74) *Attorney, Agent, or Firm* — Merchant & Gould P.C.

(57) ABSTRACT

Method for forming a collar in a muffler shell including:
providing a muffler shell made of a metal sheet and forming a muffler housing, the muffler shell having an exhaust gas opening,
providing a collar forming head having a rotational axis and at least two movable expanders,
introducing a collar forming head into a muffler housing,
moving the expanders of the collar forming head introduced into the muffler shell radially away from the rotational axis of the collar forming head from a retracted position to an expanded position
rotating the collar forming head around the of the collar forming head,
bringing the rotating expanded collar forming head in contact with the metal sheet
forming an outwardly projecting collar around the exhaust gas opening by flaring the edge of the metal sheet.

13 Claims, 5 Drawing Sheets

(51) Int. Cl.

| | |
|---|---|
| ***B21D 53/88*** | (2006.01) |
| ***B21D 19/02*** | (2006.01) |
| ***F01N 13/18*** | (2010.01) |
| ***B21D 22/14*** | (2006.01) |
| ***F01N 1/02*** | (2006.01) |
| ***B21D 22/18*** | (2006.01) |
| ***B21D 19/08*** | (2006.01) |
| ***F01N 1/00*** | (2006.01) |
| ***F01N 13/08*** | (2010.01) |

(52) U.S. Cl.

CPC ..... *B21D 22/14* (2013.01); *B21D 22/18* (2013.01); *B21D 53/88* (2013.01); *F01N 1/00* (2013.01); *F01N 1/02* (2013.01); *F01N 1/08* (2013.01); *F01N 13/08* (2013.01); *F01N 13/18* (2013.01); *F01N 13/1805* (2013.01); *F01N 13/1861* (2013.01); *F01N 13/1872* (2013.01); *F01N 13/1888* (2013.01); *F01N 2450/20* (2013.01); *F01N 2450/22* (2013.01); *F01N 2470/02* (2013.01); *F01N 2470/14* (2013.01); *F01N 2470/16* (2013.01); *F01N 2470/18* (2013.01); *F01N 2470/26* (2013.01); *F01N 2490/02* (2013.01); *F01N 2490/08* (2013.01); *F01N 2490/15* (2013.01)

(56) References Cited

U.S. PATENT DOCUMENTS

| | | | | |
|---|---|---|---|---|
| 4,400,959 | A * | 8/1983 | Reigner | B21C 37/298 29/890.11 |
| 4,413,485 | A | 11/1983 | Larikka | |
| 4,414,835 | A | 11/1983 | Larikka | |
| 4,663,812 | A | 5/1987 | Clausen | |
| 4,749,033 | A | 6/1988 | Clausen | |
| 4,856,824 | A | 8/1989 | Clausen | |
| 4,910,991 | A | 3/1990 | Bertolette et al. | |
| 5,758,908 | A | 6/1998 | Haasch | |
| 5,876,161 | A | 3/1999 | Ikola et al. | |
| 5,943,773 | A | 8/1999 | Enami | |
| 6,152,396 | A | 11/2000 | Rapila et al. | |
| 6,269,674 | B1 | 8/2001 | Sperko | |
| 6,298,757 | B1 | 10/2001 | Virtanen | |
| 7,013,699 | B1 | 3/2006 | Sperko | |
| 8,051,949 | B2 | 11/2011 | Henke et al. | |
| 8,684,131 | B1 | 4/2014 | Park et al. | |
| 8,739,923 | B1 | 6/2014 | Callahan | |
| 9,440,276 | B2 | 9/2016 | Schröer | |
| 2002/0092726 | A1 | 7/2002 | Kiviranta et al. | |
| 2004/0256854 | A1 | 12/2004 | Haunhorst et al. | |
| 2005/0056313 | A1 | 3/2005 | Hagen et al. | |
| 2005/0120981 | A1 | 6/2005 | Ferguson et al. | |
| 2005/0193545 | A1 | 9/2005 | Kiehl | |
| 2007/0240311 | A1 | 10/2007 | Kangas et al. | |
| 2007/0261786 | A1 | 11/2007 | Wang et al. | |
| 2008/0163662 | A1 | 7/2008 | Dagan | |
| 2008/0286060 | A1 | 11/2008 | Aho et al. | |
| 2009/0032332 | A1 | 2/2009 | Reuther et al. | |
| 2009/0107989 | A1 | 4/2009 | Gramoll et al. | |
| 2010/0116586 | A1 | 5/2010 | Andre et al. | |
| 2011/0024227 | A1 | 2/2011 | Gorke et al. | |
| 2011/0192676 | A1 | 8/2011 | Wirth | |
| 2011/0272209 | A1 | 11/2011 | Tauschek et al. | |
| 2012/0273296 | A1 | 11/2012 | Nording et al. | |
| 2013/0213734 | A1 | 8/2013 | Ahn et al. | |
| 2014/0284138 | A1 | 9/2014 | Murakami et al. | |
| 2015/0047922 | A1 | 2/2015 | Vollmer et al. | |
| 2016/0002950 | A1 | 1/2016 | Hancock | |

FOREIGN PATENT DOCUMENTS

| | | | | |
|---|---|---|---|---|
| CA | 2496656 | A1 | 5/2006 | |
| CN | 1732057 | A | 2/2006 | |
| CN | 201664765 | U | 12/2010 | |
| CN | 205651060 | U | 10/2016 | |
| CN | 106180436 | A | 12/2016 | |
| DE | 102005026376 | A1 | 12/2006 | |
| DE | 102009018957 | A1 | 10/2010 | |
| DE | 102009023029 | A1 | 12/2010 | |
| DE | 102010015322 | A1 | 10/2011 | |
| DE | 102010020826 | A1 | 11/2011 | |
| DE | 102010052468 | A1 | 5/2012 | |
| DE | 102011106366 | A1 | 12/2012 | |
| DE | 102013019692 | A1 | 5/2015 | |
| EP | 0496387 | A2 | 7/1992 | |
| EP | 0752289 | A2 | 1/1997 | |
| EP | 1048418 | A2 | 11/2000 | |
| EP | 1099492 | A2 | 5/2001 | |
| EP | 1627997 | A1 * | 2/2006 | F01N 1/083 |
| EP | 2196640 | A2 | 6/2010 | |
| EP | 2375017 | A2 | 10/2011 | |
| FI | 880521 | | 8/1989 | |
| FI | 20045104 | A | 9/2005 | |
| FI | 20045105 | A | 9/2005 | |
| FI | 20045106 | A | 9/2005 | |
| JP | S61-135860 | A | 6/1986 | |
| JP | H08117877 | A * | 5/1996 | B21C 37/298 |
| JP | 2009-078275 | A | 4/2009 | |
| WO | 2004/035187 | A2 | 4/2004 | |
| WO | 2004/090410 | A1 | 10/2004 | |
| WO | 2011/061213 | A1 | 5/2011 | |

OTHER PUBLICATIONS

Search Report for European Patent Application No. 17182504.5, dated Nov. 7, 2017.

* cited by examiner

METHOD FOR FORMING A COLLAR IN A MUFFLER HOUSING

This application claims benefit of Ser. No. 17/182,504.5, filed on 21 Jul. 2017 in the European Patent Office and which application is incorporated herein by reference. To the extent appropriate, a claim of priority is made to the above disclosed application.

FIELD OF THE INVENTION

The present invention relates to a method for forming a collar in a muffler housing of a muffler for an internal combustion engine.

BACKGROUND

Due to increasing flexibility requirements as well as the requirements to have common components for different vehicle platforms, mufflers, in particular rear mufflers, tend to be designed to accommodate the space below the trunk in a direction transverse to the driving direction. Such transverse muffler also allows for very easy design and integration of two tail pipes which are arranged on each side of the back of the vehicle. The transverse muffler is then located at the rear of the car beneath the trunk in a direction parallel to the rear axle. Although this arrangement allows the use of the distance between the two wheels, hence allowing a muffler length of up to 800 mm and more, this arrangement, however, requires that the height of the transverse muffler has to be reduced, in order to maintain the trunk capacity, when compared to the longitudinal mufflers oriented from front to rear in the direction of the vehicle (driving direction of the vehicle). Such flat shape of a transverse rear muffler allows the muffler to fit under the bottom floor of the trunk of the car with minimal trunk volume loss.

In order to allow easy integration of the transverse muffler with the exhaust system, side entry—meaning an exhaust pipe entry through the muffler housing on the longitudinal side of the muffler conveying the exhaust gases from the internal combustion engine to the muffler—of the exhaust pipe through the wall of the muffler shell into the muffler is of particular interest as the exhaust pipe(s) upstream of the transverse rear muffler conveying the exhaust gases into the rear muffler are typically positioned in the middle tunnel underneath the car. It is therefore beneficial that the exhaust tube enters the transverse rear muffler through the muffler shell of the muffler in order to prevent additional exhaust pipe length and additional bends (curved pipe portions) leading to additional backpressure, costs and reduced compactness of the exhaust system. Alternatively, side exit, meaning an exit pipe emanating from the muffler housing on the longitudinal side of the muffler for discharging the exhaust gasses from the muffler, may be required.

For allowing leak-tight and secure connection, the formation of such side entry or side exit includes the formation of a collar for connecting the exhaust tube or the exhaust pipe to the transverse muffler. In particular, the side entry will be located on the side of the flat transverse muffler where the radius of curvature of the muffler shell is small. Problems occur, however, during formation of the collar at such highly curved positions, such as rupture of the muffler shell sheet and reproducibility of the tubular connection regarding, for example, tube welding.

Therefore, making the collar hole on the side of the transverse muffler is a technical challenge, especially for very flat mufflers where the collar has to be made in an area of the muffler shell where the radius of the muffler shell is very small and hence strongly curved. In extreme cases, the diameter of the collar, which needs to fit the diameter of the exhaust pipe, is only marginally smaller than the height of the muffler itself. Such a situation particularly occurs for exhaust systems for powerful engines with high mass flow rates which need large pipe diameters.

Current methods to generate collars are based on stamping and drawing, making use of a punch (or die) to be pulled in one or more linear strokes, for example several dies with increasing diameter.

The existing methods have drawbacks for making collars in highly curved sheets such as in flat transverse mufflers with a collar situated in the curved region of the muffler shell. One drawback is that the material the muffler shell is made of, generally steel, cannot flow sufficiently from the highly curved muffler shell to the corner when pulling the die through the hole. Extreme thinning occurs up to the rupture limit where the collar starts to crack. When a crack occurs in the collar, the muffler shell or even the entire muffler has to be scrapped because the connection between the muffler and the exhaust tube would not be durable and leak-tight. In order to avoid cracks, multiple dies having increasing diameters may be used in a step-by-step process, thereby stepwise forming the collar. Such step-by-step process, described in the following for a rolled shell muffler, involves multiple process steps during which each die has to be first introduced into the inner space (interior) of the muffler through the end cap openings where the end caps close the muffler at a later stage, because the die, having a diameter larger than the side entry hole, cannot be introduced into the inner space (interior) of the muffler through the side entry hole. This requires that the collar is formed while the interior components (e.g. baffles) of the muffler are not yet inserted (i.e. before stuffing). At this stage, the muffler housing is not supported by the baffles, for example, and can therefore be easily deformed during formation of the collar. Such deformation of the muffler housing is not acceptable and the muffler housing has to be scrapped. Therefore, this procedure is a very time-consuming and very expensive multiple step process which does not ensure proper collar formation without cracks. Even in case the collar is formed without cracking, the end circumference of the collar is crenated due to the large deformations caused. Crenations are generally roughness of the collar mouth and initiations of cracks around the collar that are generated by the collar forming step with the state of the art methods.

Crenations have a negative impact on the durability of weld connections between the exhaust pipe and the side entry collar, making additional steps of machining necessary to eliminate crenations. Besides such additional machining step being time-consuming and expensive, the metal burrs or particles generated by machining are not desired, as they may get trapped in the end product. Such metal burrs or particles may then cause rattling noises in the muffler. Removal of machining burrs, constantly cleaning the tools etc., once again increase the complexity and the costs of the production.

It is therefore an object of the present invention to overcome the drawbacks of existing methods of making collars.

In order to overcome these problems, the present invention suggests a method as it is specified by the features of the independent claim. Embodiments of the method according to the invention are the subject of dependent claims.

SUMMARY OF THE INVENTION

The invention relates to a method for forming a collar in a muffler housing for a muffler for an internal combustion engine, the method comprising:

- providing a muffler shell made of a metal sheet and forming a muffler housing, the muffler shell having an exhaust gas opening,
- providing a collar forming head having a rotational axis and at least two movable expanders,
- introducing the collar forming head into the muffler housing, wherein the expanders are in a retracted position, by moving the retracted collar forming head along the rotational axis through the exhaust gas opening in the muffler shell, wherein the retracted collar forming head has a largest diameter smaller than a largest diameter of the exhaust gas opening in the muffler shell,
- moving the expanders of the collar forming head introduced into the muffler housing radially away from the rotational axis of the collar forming head from the retracted position to an expanded position, in which the largest diameter of the expanded collar forming head radially to the rotational axis is larger than the largest diameter of the exhaust gas opening,
- rotating the collar forming head around the rotational axis of the collar forming head,
- bringing the rotating expanded collar forming head in contact with the metal sheet adjacent to and surrounding the exhaust gas opening in the muffler shell by moving the expanded collar forming head along the rotational axis in a direction outwardly from the interior of the muffler housing,
- forming an outwardly projecting collar around the exhaust gas opening by flaring the edge of the metal sheet surrounding the exhaust gas opening outwardly and increasing the size of the exhaust gas opening by moving the expanded collar forming head along the rotational axis (in a direction outwardly from the interior of the muffler housing to the exterior of the muffler housing).

The smallest diameter of the exhaust gas opening is the largest diameter of a circle or cylinder which is confined by the exhaust gas opening. The largest diameter of the exhaust gas opening is the smallest diameter of a circle or cylinder which confines the exhaust gas opening. In particular, these diameters are measured in a plane projecting radially away from and perpendicular to the rotational axis of the collar forming head.

When the exhaust gas opening has an elongation and the collar forming head is not circular and has a largest diameter smaller than a largest diameter of the exhaust gas opening in the muffler shell, but larger than the smallest diameter of the exhaust gas opening, the collar forming head is introduced into the exhaust gas opening in a position in which the elongation of the collar forming head is in the direction of the elongation of the exhaust gas opening. Particularly, however, the largest diameter of the collar forming head may be smaller than the smallest diameter of the exhaust gas opening in the muffler shell.

The expanders of the collar forming head may be moved in a radial direction away from the rotational axis. This movement may be performed in a direction perpendicular to the rotational axis or alternatively inclined at an angle relative the direction perpendicular to the rotational axis.

The exhaust gas opening may be the raw opening before any collar formation has been done or an already existing collar formed in a previous step of the collar formation in case of stepwise formation of the collar.

The rotation of the collar forming head has to occur at the stage of bringing the expanded collar forming head in contact with the metal sheet adjacent to and surrounding the exhaust gas opening. The collar forming head may, however, already rotate at any time before this step.

The method according to the invention allows for very efficient and reliable collar formation in a muffler housing while reducing the risks of cracks. This method is particularly advantageous for double layered muffler shells forming the muffler housing. In particular, the rotation of the expanders allows a very gentle formation of the collar in order to form a collar of excellent quality.

The method allows for collar formation in a muffler housing of a rolled envelope type muffler (muffler housing made of one muffler envelope—which may comprise one or more layers of metal sheet—rolled to form the muffler housing) or half-shell type mufflers (muffler housing made from two muffler shell halves joined together). In the half-shell type muffler, either one shell half or both shell halves have an exhaust gas opening. Outwardly projecting collars may be formed on one or more of the exhaust gas openings either for the half-shell type muffler or for the rolled envelope type muffler.

In case of a half-shell type muffler, the muffler housing comprises two shell halves which are joined together to form the muffler housing. When referring to the muffler shell or to the muffler housing, it is to be understood that the muffler shell or the muffler housing may be formed by two half-shells.

The collar formation may be particularly performed in one step. This means that the collar is particularly formed without incremental step-by-step formation of the collar. The diameter of the collar forming head has the diameter of the final collar to be formed during the step of collar formation.

According to a further aspect of the method according to the invention, the method further comprises the step of inserting muffler interior components into the muffler housing which is performed prior to the step of forming the outwardly projecting collar.

The insertion of the muffler interior components prior to the step of forming the collar allows for a very efficient manufacturing process of the muffler and reduces the risk of distortions of the muffler housing which is supported by the muffler interior components.

According to yet a further aspect of the method according to the invention, the method further comprises a step of inserting the muffler interior components into the muffler housing which is performed after the step of forming the outwardly projecting collar The insertion of the muffler interior components after collar formation is particularly advantageous in case an internal pipe is already attached to the muffler interior before insertion into the muffler housing. In case of a half-shell type muffler, for example, the muffler interior components may then be easily introduced into one of the half shells of the muffler, before the second half shell is joined to the first half shell to close the muffler. Insertion of the muffler interior after collar formation may also be advantageous in case of an internal pipe having a bend as introduction into the interior space of the muffler housing is simplified.

Still in accordance with a further aspect of the method according to the invention, the method comprises inserting an internal pipe into the muffler housing through the outwardly projecting collar. The insertion of the internal pipe may be done from the inside (interior space of the muffler housing) of the muffler housing through the outwardly projecting collar towards the exterior of the muffler housing (in this case before the insertion of the muffler interior components) or from the outside of the muffler housing through the outwardly projecting collar into the inner space of the muffler housing (in this case either before or after the insertion of the muffler interior components).

The internal pipe penetrates into the housing of the muffler for introducing exhaust gas into or for discharging exhaust gas from the muffler. The internal pipe may have a plurality of punched apertures along the circumference. Thus, the high frequencies contained in the exhaust noise are reduced and the exhaust noise is tuned to a low noise in low and middle frequency bands. The internal pipe particularly protrudes outwardly from the collar mouth over a distance of up to 10 mm, particularly up to 5 mm, very particularly from 1 mm to 3 mm.

Yet in accordance with another aspect of the method according to the invention, forming the outwardly projecting collar around the exhaust gas opening comprises the formation of a collar wall and after the step of inserting of the internal pipe the internal pipe is expanded to contact the wall of the outwardly projecting collar.

The step of expanding the internal pipe to contact the wall of the outwardly projecting collar is also referred to as calibration. The calibration allows for a leak-tight joint in the muffler manufactured. Additionally, the calibration allows for reproducibly and durably joining the pipes in the muffler manufactured either by mechanical locking, such as ridge lock, or by welding.

According to still a further aspect of the method according to the invention, the method comprises the step of inserting an external pipe into the internal pipe through the outwardly projecting collar.

The external pipe is, for example, an inlet exhaust tube conducting the exhaust gases from the internal combustion engine to the muffler or a tail pipe for discharging the exhaust gases from the muffler. The external pipe is particularly welded to the outwardly projecting collar. Particularly, when the internal pipe projects outwardly from the collar mouth, the weld will join the external pipe, the internal pipe and the outwardly projecting collar.

According to a further aspect of the method according to the invention, the step of providing a muffler shell comprises forming a rolled envelope muffler housing made from the muffler shell.

According to an alternative aspect of the method according to the invention, the step of providing a muffler shell comprises providing two muffler shell halves for forming a muffler housing made from two muffler shell halves, and wherein the exhaust gas opening is provided in at least one of the muffler shell halves.

In case of a half-shell type muffler, the step of forming an outwardly projecting collar is particularly performed after the step of inserting the muffler interior components into muffler housing and joining the two muffler shell halves to form a closed muffler housing. This sequence allows for the formation of the outwardly projecting collar on a particularly stiff muffler housing. The muffler interior components include, for example, baffles and pipes.

In accordance with a further aspect of the method according to the invention, the step of providing a muffler shell comprises providing at least one flat metal sheet comprising the exhaust gas opening, and rolling the metal sheet to form the muffler housing or deep drawing the metal sheet to form at least one of two shell halves.

In accordance with another aspect of the method according to the invention, the step of providing a muffler shell comprises providing two flat metal sheets and deep drawing the metal sheets to form two shell halves and forming the exhaust gas opening during the deep drawing step in at least one of the shell halves.

Still in accordance with a further aspect of the method according to the invention, the step of providing a muffler shell comprises providing at least one flat metal sheet, rolling the metal sheet to form the muffler housing or deep drawing the metal sheet to form at least one of two shell halves, and subsequent to the rolling or deep drawing step forming the exhaust gas opening.

In accordance with a still further aspect of the method according to the invention, the step of providing a muffler shell comprises providing a muffler shell with an elongated exhaust gas opening adapted to form a collar having a planar mouth in a direction radial to the rotational axis.

A planar mouth with a smooth edge having no crenations allows a reliable, reproducible and durable joint connection with the exhaust pipe, e.g. by robot welding, thereby minimizing manual weld repairing.

Hence, a planar mouth is particularly advantageous for collar forming on mufflers when two tubes and a collar are welded together at the same time with one weld. The internal tube which is inserted into the muffler through the formed collar has a straight cut and slightly protrudes from the collar mouth. The external tube (e.g. the intermediate tube in the tunnel, or the tailpipe) is inserted inside of the internal tube (typically over a depth of 15 to 30 mm). The planar mouth of the collar allows easy welding along the cut of the internal tube, such that by welding the internal tube, the external tube and the collar mouth are joined together by the weld.

The method according to the invention avoids machining of the collar for the reliable connection of the exhaust pipe to the collar. Furthermore, this method prevents burrs and particles from the machining to enter the interior of the muffler, leading to additional steps of removal of the debris from the muffler. In particular, the elongated exhaust gas opening may be elliptical or oval and is designed and tuned to avoid machining subsequent to the collar forming step.

In accordance with another aspect of the method according to the invention, the step of forming an outwardly projecting collar comprising a collar mouth at the end of the collar, in a direction away from the muffler shell, comprises forming a collar mouth having a circular shape.

In particular, providing a collar forming head comprises providing a collar forming head having expanders configured to be moved into various expanded positions, thereby varying the diameter of the expanded collar forming head.

Such configuration allows for a flexible use of the method which is then adapted for the formation of collars for diverse exhaust pipes with different diameters to be connected to the side entry of the muffler. Additionally, this method allows for incremental step-by-step formation of the collar by increasing stepwise the diameter of the collar forming head.

The step of introducing a collar forming head in a retracted position into the muffler housing of the muffler, moving the expanders of the collar forming head to an expanded position and bringing the rotating expanded collar forming head in contact with the metal sheet surrounding the exhaust gas opening in the muffler shell may alternatively be repeated for a step-by-step formation of the collar by step-by-step increase of the diameter of the collar forming head.

The steps are, in the incremental process, repeated until the final diameter of the collar is reached. This incremental method is facilitated by the particular use of the collar forming head. In addition to the rotation of the collar forming head, the incremental method allows for an even more gentle formation of the collar in the muffler housing.

The step of forming an outwardly projecting collar comprising a collar mouth at the end of the collar, in a direction away from the muffler shell, may comprise forming a collar mouth having a circular shape. The collar mouth may alternatively be elongated and have an elliptical or oval shape, for example.

The step of providing a collar forming head may particularly comprise providing a collar forming head movable along the rotational axis towards and away from the exhaust gas opening in the muffler shell and having expanders configured to engage portions of said muffler shell adjacent to and surrounding the exhaust gas opening to form a collar, a mounting portion holding the expanders on the collar forming head, the expanders being configured for a movement radially of the rotational axis between a retracted position and an extended collar forming position.

The step of providing a collar forming head may comprise providing a collar forming head, an actuator for moving said collar forming head relatively to the exhaust gas opening in the muffler shell into and away from the exhaust gas opening along an axis, expanders adapted to engage portions of the muffler shell adjacent to and surrounding the exhaust gas opening to form a collar, and a mounting portion movably holding the expanders on the collar forming head configured for a movement axially and radially with respect to the rotational axis between a retracted position and an extended collar forming position, wherein at least portions of the expanders come to lie under the edge of the muffler shell adjacent to the exhaust gas opening in the expanded position.

The expanders may be inclined with respect to the rotational axis.

Each and every feature described herein, and each and every combination of two or more of such features, is included within the scope of the present invention provided that the features included in such a combination are not mutually inconsistent. In addition, any feature or combination of features may be specifically excluded from any embodiment of the present invention.

BRIEF DESCRIPTION OF THE DRAWINGS

The invention is further described with regard to embodiments, which are illustrated by means of the following drawings, wherein.

DETAILED DESCRIPTION OF EMBODIMENTS

Figure 1:
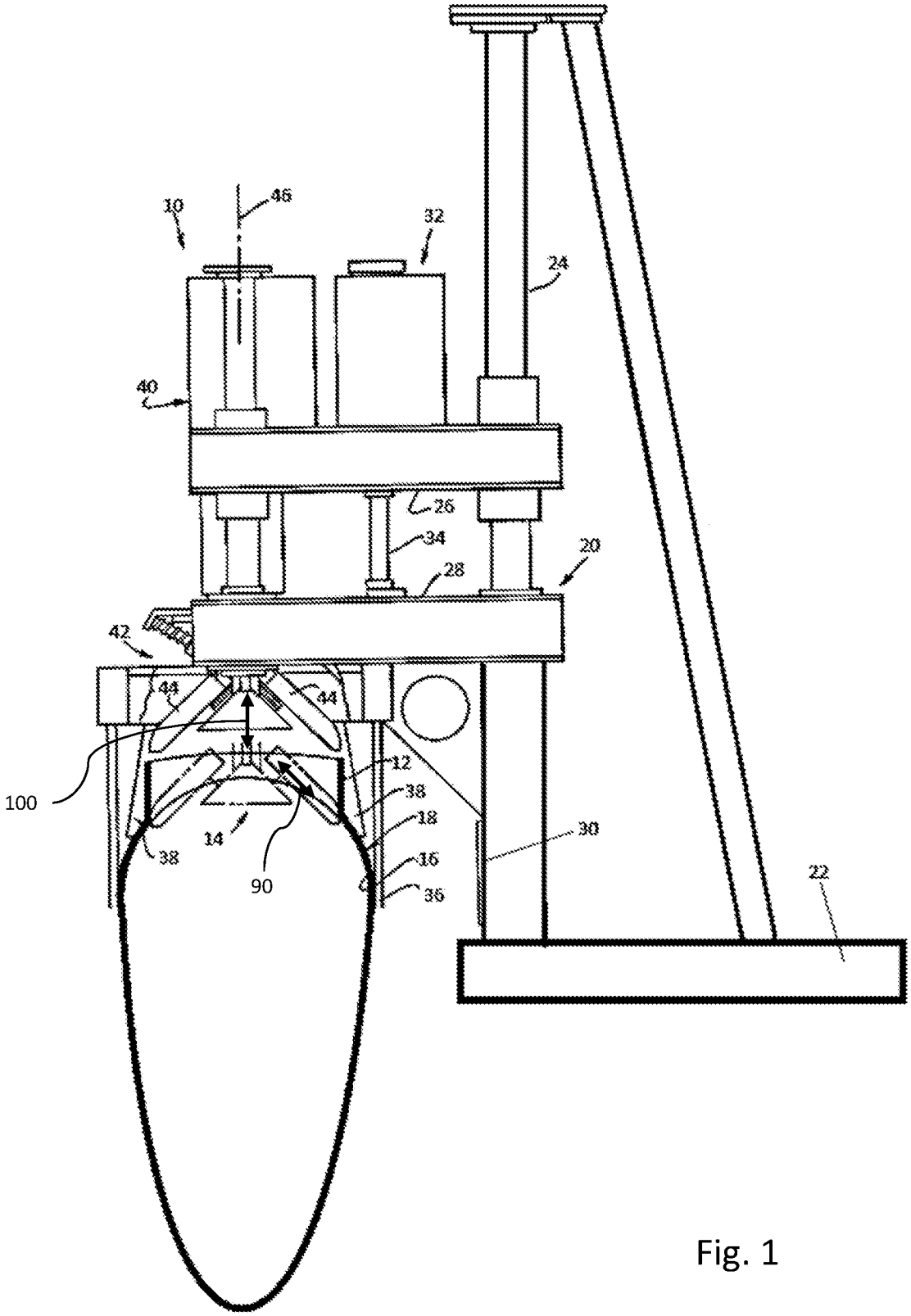
FIG. 1 is a side elevational view of an embodiment of the collar forming apparatus for performing the method according to the present invention.

Referring to the drawing, the collar forming apparatus of the present invention, indicated generally at 10, is shown in FIG. 1 in a position immediately subsequent to the formation of a collar or neck 12 around an exhaust gas opening 14 in the metal sheet 16 of a muffler shell 18. The collar forming apparatus 10 includes a frame 20 having a base 22 to which upright support columns 24 (one shown) are secured. A pair of vertically spaced apart tables 26 and 28 is slidably mounted to the support columns 24 for movement relative to the base 22 and for movement relative to each other. A hydraulic cylinder 30 is interposed between the base 22 and the lower table 28 and is operable to raise and lower the table 28. A vertical displacement actuator 32 having a rod 34 connects the upper table 26 with the lower table 28 in an adjusted fixed position so that operation of the hydraulic cylinder 30 causes simultaneous movement of the tables 26 and 28, while operation of the vertical displacement actuator 32 causes relative vertical movement between the upper table 26 and the lower table 28.

Clamping the muffler housing may be done with a flexible member 36 secured to the underside of the lower table 28 and wrapping around the muffler shell 18 holding it firmly against support feet 38 secured to the underside of the table 28. The vertical adjustable movement of the table 28 allows the collar forming apparatus 10 to accommodate exhaust gas openings in muffler shells having a variety of diameters. Any other method for holding the muffler is however applicable.

The upper table 26 carries a drive 40 which extends through the lower table 28 for vertical movement relative thereto and to which drive 40 is secured a collar forming head 42. Expanders 44 which form the collar during operation are mounted to the collar forming head 42 and are operable to engage the metal surrounding the exhaust gas opening 14, thereby varying the diameter of the collar forming head 42. When rotated by the drive 40 about an upright rotational axis 46 of the collar forming head 42 while being withdrawn from the exhaust gas opening 14 along an axial path from the inside of the muffler shell to the outside of the muffler shell, the expanders 44 work the metal to form the collar 12. The movement of the collar forming head 42 along the rotational axis 46 is achieved by operation of the vertical displacement actuator 32 which causes the upper table 26 to move up and down relative to the table 28 so as to move the collar forming head 42 and the expanders 44 up and down.

The collar forming head 42 carries symmetrically arranged expanders 44. The expanders are movable and are configured to vary the diameter of the collar forming head 42 in a radial direction relative to the rotational axis 46.

The expanders 44 may be displaced to their expanded collar forming positions or to their retracted positions, thereby varying the diameter of the collar forming head. The movement of the expanders is shown by the arrows in FIG. 2.

Figure 2:
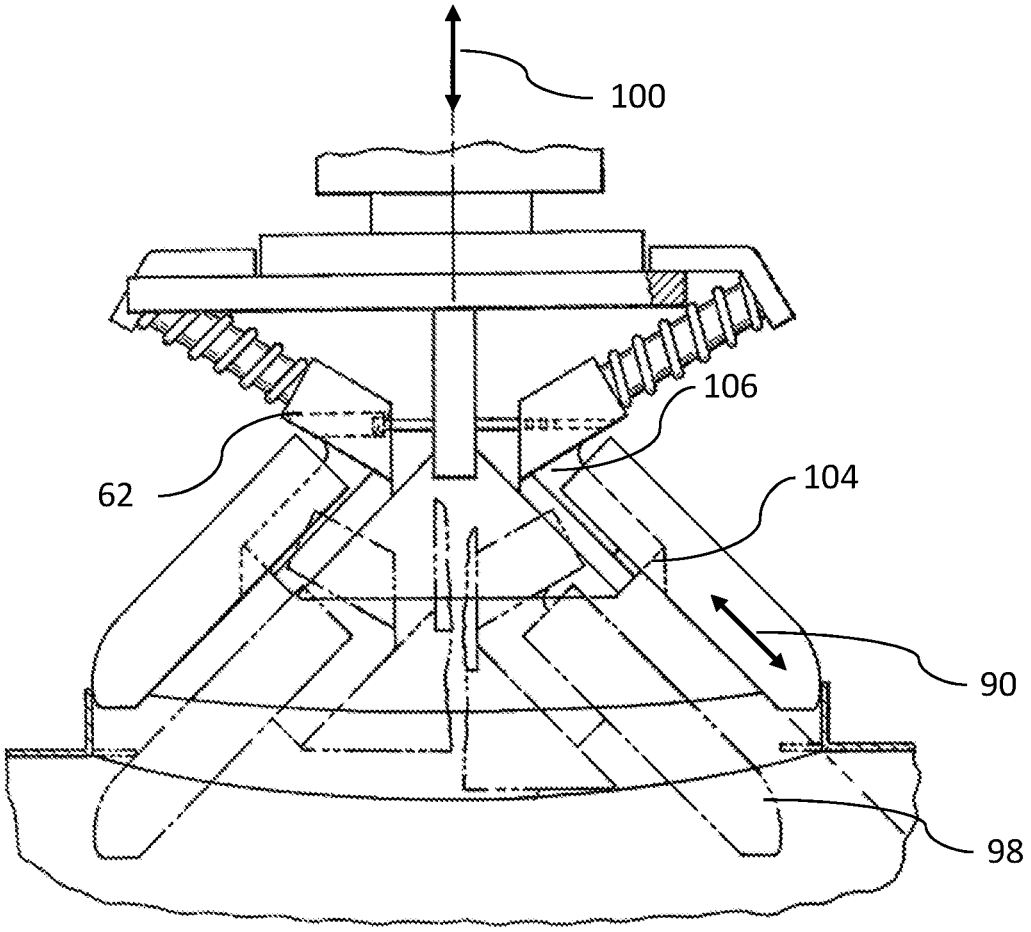
FIG. 2 is a fragmentary elevational view of the collar forming apparatus of FIG. 1, showing in broken lines the retracted and expanded collar forming positions of the flange forming members and showing in unbroken lines the flange forming members in their expanded collar forming positions withdrawn from the muffler shell.

As shown in FIG. 2, each expander 44 has a longitudinal axis and includes a working surface 98 from which side walls extend transversely. A longitudinal groove 104 is formed in each expander 44 to receive a rectangular mounting portion 106 of the support member 62, with the expander 44 being secured to the support member 62 in a suitable manner. Accordingly, a variety of sizes and shapes of the expanders 44 can be interchangeably mounted to the support members 62 to fit the hole size, the metal sheet thickness, and the composition of the muffler shell 18.

In operation, the muffler shell 18 is clamped against the feet 38 by the clamp 36. The expanders 44 are in their retracted positions as shown in broken lines in the right hand side of FIG. 2. The vertical displacement actuator 32 is then operated to lower the upper table 26 relative to the lower table 28 in order to lower the collar forming head 42 to insert the retracted expanders 44 through the exhaust gas opening 14 into the inner space (interior) of the muffler shell 18. Next, the expanders 44 are moved to their expanded collar forming positions, as shown in broken lines on the left hand side of FIG. 2 where they come to lie under the portions of the metal sheet 16 surrounding the exhaust gas opening 14.

The collar 12 is then formed by working the metal surrounding the exhaust gas opening 14. This working of the metal is performed by actuating the drive 40 which rotates the collar forming head 42 about the axis 46 thereby rotating the expanders 44. The vertical displacement actuator 32 is then actuated to raise the upper table 26 thus withdrawing the rotating expanders 44 from the exhaust gas opening 14. During this process, the rotating expanders 44 work the metal surrounding the exhaust gas opening 14 to form the upstanding collar 12 and are held in their (expanded) collar forming positions. As shown in unbroken lines in FIG. 2, the expanders 44 are shown in a position in which the collar forming procedure is essentially complete. Thereafter, the muffler shell 18 is indexed to another position for the next process step.

Another muffler shell may then be secured to the underside of the table 28 with the exhaust gas opening in the metal sheet of the muffler shell positioned in alignment with the collar forming head 42.

Figure 3A:
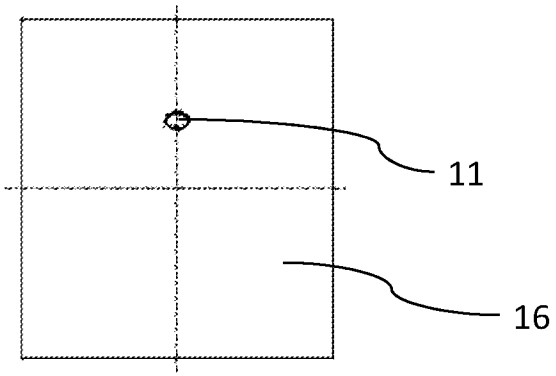
FIGS. 3*a* to 3*h* show the steps of the method for forming a collar in the muffler housing according to one embodiment of the inventive method.
Figure 3B:
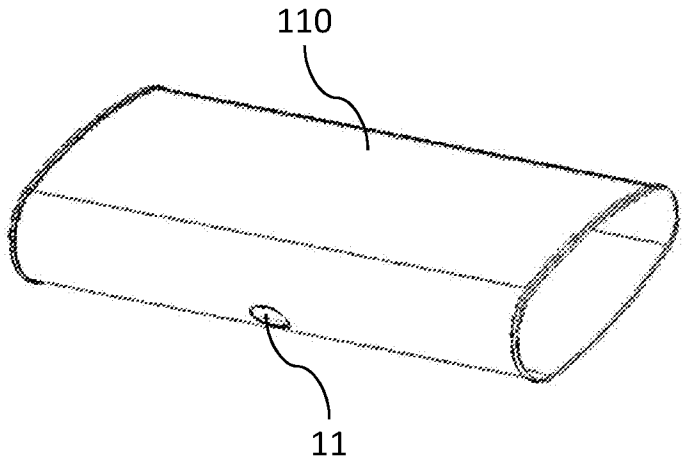

FIGS. 3*a* to 3*h* show the various steps of the muffler manufacturing according to one embodiment of the present invention for a rolled muffler 100. Shown in FIG. 3*a*, a flat sheet of metal 16 with an exhaust gas opening 11 is provided. The exhaust gas opening 11 has an elongated shape adapted to form an outwardly projecting collar having a planar mouth in a direction radial to the rotational axis of the collar forming head 42 once the collar 12 is formed. The flat metal sheet 16 is then rolled in order to form the rolled envelope 110 (muffler housing) of the muffler as shown in FIG. 3*b*. The rolled envelope 110 has the exhaust gas opening 11 at a location where the curvature radius of the muffler housing is low.

Figure 3C:
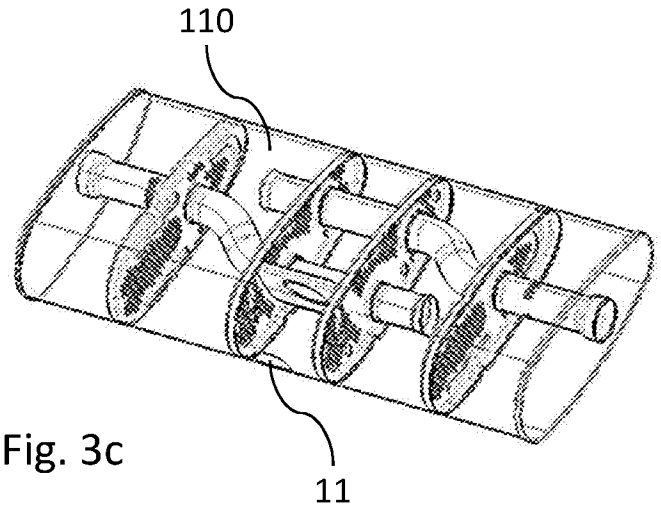
Figure 3D:
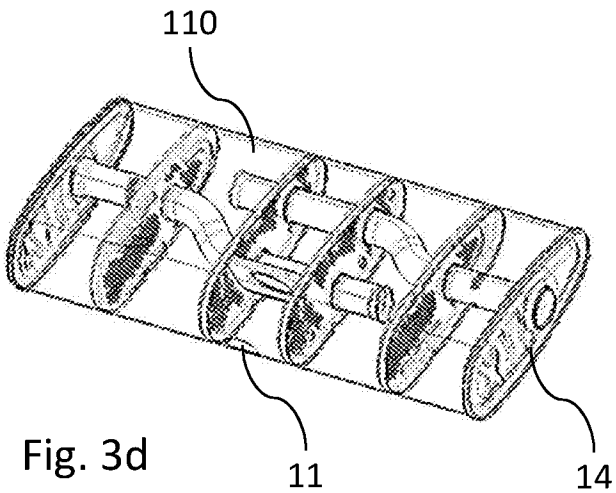
Figure 3F:
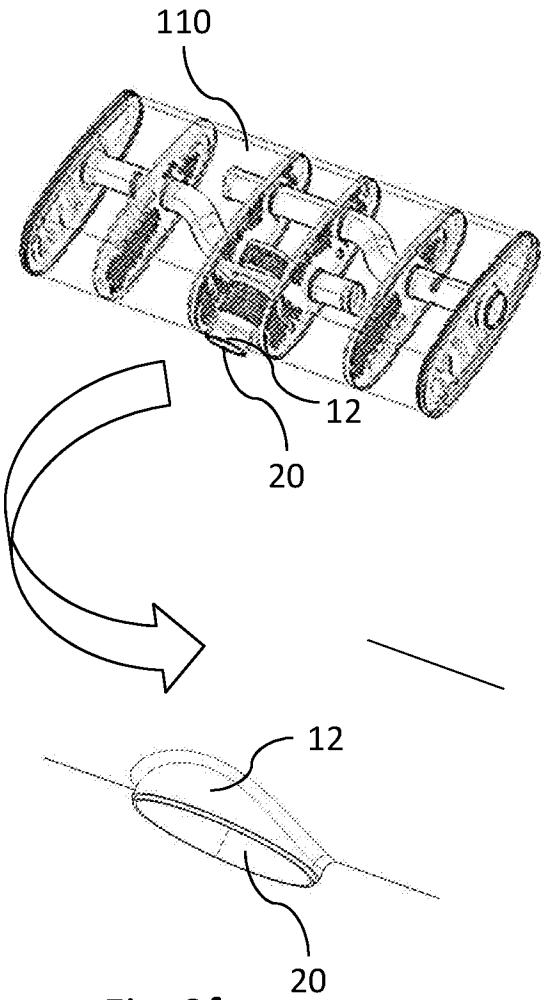

In the next step shown in FIG. 3*c*, the stuffing of the muffler interior components 120 into muffler shell 110 (muffler housing) is performed, and subsequently the step of end capping the muffler, i.e. providing the rolled envelope 110 (muffler housing) with end caps 140 thereby closing the muffler are performed, as shown in FIG. 3*d*. The muffler housing 110 provided with the end caps 140 now has maximal stability for reduced distortion during the collar forming step.

Figure 3E:
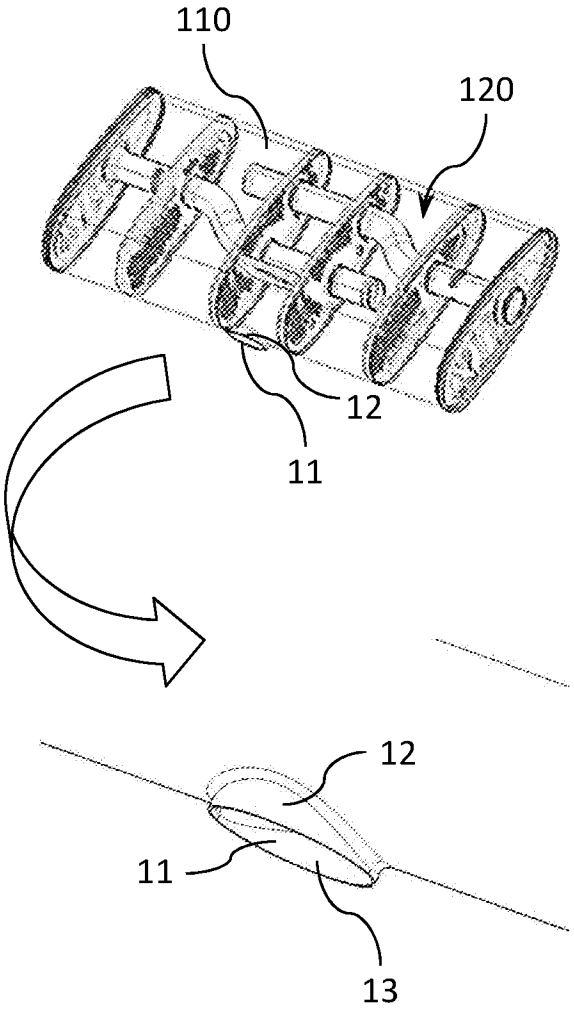
Figure 3H:
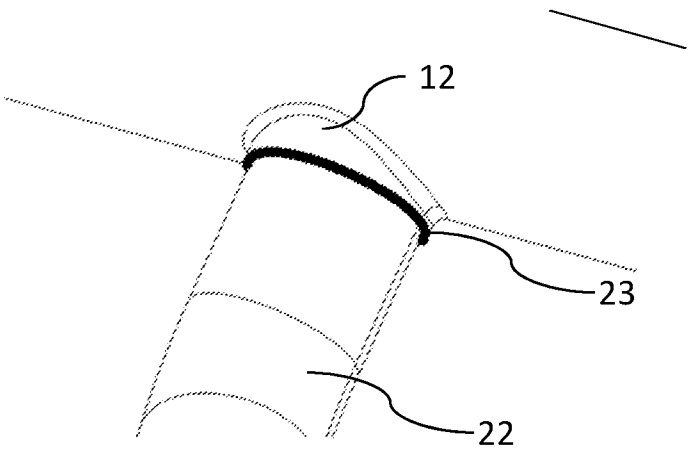

Subsequently, as shown in FIG. 3*e*, the outwardly projecting collar 12 is formed by the method as described in detail hereinbefore. In particular, a collar forming head 42 is introduced into the interior space of the rolled envelope 110 with the expanders 44 being in a retracted position (retracted collar forming head 42), by moving the retracted collar forming head 42 along the rotational axis 46 of the collar forming head 42 through the exhaust gas opening 11 in the muffler shell 18. The expanders 44 of the collar forming head are then moved radially away from the rotational axis 46 of the collar forming head 42 from the retracted position to the expanded position (expanded collar forming head 42). While rotating the expanded collar forming head 42 around the rotational axis 46 of the collar forming head 42, the rotating expanded collar forming head 42 is brought in contact with the metal sheet 16 adjacent to and surrounding the exhaust gas opening 11 in the rolled envelope 110 by moving the expanded collar forming head 42 along the rotational axis 46 in a direction outwardly from the interior of the rolled envelope 110 and thus forming an outwardly projecting collar 12 around the exhaust gas opening 11 by flaring the edge of the metal sheet 16 surrounding the exhaust gas opening 11 outwardly and increasing the size of the exhaust gas opening 11 by moving the expanded collar forming head 42 along the rotational axis 46. Forming the outwardly projecting collar 12 is performed in one step, thereby forming the collar 12 without the need of repeating the collar forming step.

As can be best seen from FIG. 3*e* and particularly in the zoomed representation of the collar, the elongated exhaust gas opening 11 has a shape adapted to form an outwardly projecting collar 12 having a planar mouth.

Subsequent to forming the outwardly projecting collar 12, an internal pipe 20 is introduced into the muffler through the outwardly projecting collar 12. As can be seen from FIG. 3*f* and particularly in the zoomed representation of the collar, the internal pipe 20 slightly protrudes from the collar mouth over about 1 mm length. The internal pipe 20 may be joined to the muffler interior 120 by mechanical lock or press fit (fastening between the two parts which is achieved by friction after the parts are joined together). After the internal pipe 20 has been introduced into the muffler, the internal pipe 20 is slightly expanded to touch the wall 13 of the outwardly projecting collar 12 in the calibration step to ensure connection between the collar 12 and the internal pipe 20.

Figure 3G:
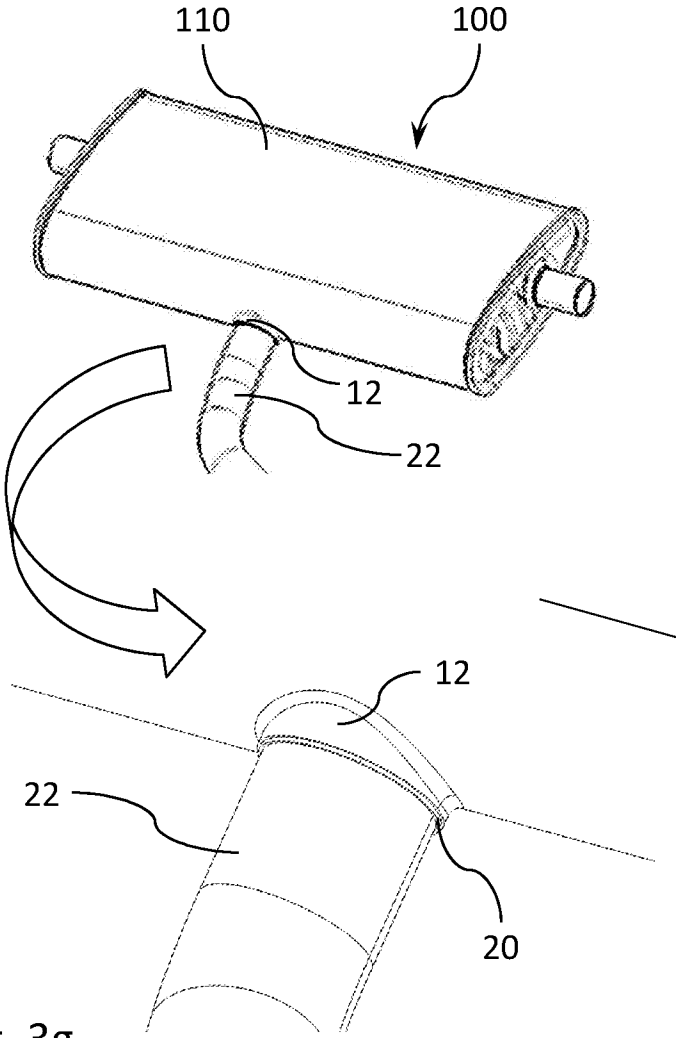

Finally, an external pipe 22 is introduced over about 1 cm into the internal pipe of the muffler as shown in FIG. 3*g* and particularly in the zoomed representation of the collar with the external pipe 22 and the internal pipe 20. Subsequently, the external pipe 22 is welded to the outwardly projecting collar 12. The weld 23 also joins the protruding part of the internal pipe 20 to the collar 12 and to the external pipe 22 as can be seen best from FIG. 3*h* which is a zoomed representation of the collar with the external pipe 22 and the internal pipe 20.

From the above description, it can be seen that an improved collar forming method is provided for forming collars in muffler housings having a variety of metal sheet thicknesses, exhaust gas openings and material compositions, irrespective of the stuffing of the muffler. The expanders are configured to allow a variety of collar forming head diameters, thereby allowing flexible use for the collar forming head for any kind of muffler having a wide variety of collar diameters and lengths, thus providing for an enhanced versatility of the method. Additionally, the method allows for collar formation in muffler half shells of half-shell type mufflers.

The invention claimed is:

1. A method for forming a collar in a muffler shell for a muffler for an internal combustion engine, the method comprising:

providing a muffler shell made of a metal sheet and forming a muffler housing, the muffler shell having an exhaust gas opening, providing a collar forming head having a rotational axis and at least two movable expanders, introducing the collar forming head into the muffler housing, wherein the expanders are in a retracted position, by moving the retracted collar forming head along the rotational axis through the exhaust gas opening in the muffler shell, wherein the retracted collar forming head has a largest diameter smaller than the largest diameter of the exhaust gas opening in the muffler shell, moving the expanders of the collar forming head introduced into the muffler housing radially away from the rotational axis of the collar forming head from the retracted position to an expanded position, in which the largest diameter of the expanded collar forming head radially to the rotational axis is larger than the largest diameter of the exhaust gas opening, rotating the collar forming head around the rotational axis of the collar forming head, bringing the rotating expanded collar forming head in contact with the metal sheet adjacent to and surrounding the exhaust gas opening in the muffler shell by moving the expanded collar forming head along the rotational axis in a direction outwardly from the interior of the muffler housing, forming an outwardly projecting collar around the exhaust gas opening by flaring the edge of the metal sheet surrounding the exhaust gas opening outwardly and increasing the size of the exhaust gas opening by moving the expanded collar forming head along the rotational axis in a direction outwardly from the interior of the muffler housing to the exterior of the muffler housing, and inserting muffler interior components into the muffler housing prior to the step of forming the outwardly projecting collar.

2. The method according to claim 1, wherein the step of forming the outwardly projecting collar is performed in one step.

3. The method according to claim 1, wherein the method comprises the step of inserting an internal pipe into the muffler housing through the outwardly projecting collar.

4. The method according to claim 3, wherein forming the outwardly projecting collar around the exhaust gas opening comprises the formation of a collar wall, and wherein after the step of inserting the internal pipe, the internal pipe is expanded to contact the collar wall.

5. The method according to claim 3, wherein the method comprises the step of inserting an external pipe into the internal pipe through the outwardly projecting collar.

6. The method according to claim 1, wherein the step of providing a muffler shell comprises forming a rolled envelope muffler housing from the muffler shell.

7. The method according to claim 1, wherein the step of providing a muffler shell comprises providing two muffler shell halves for forming a muffler housing from the two muffler shell halves, and wherein the exhaust gas opening is provided in at least one of the two muffler shell halves.

8. The method according to claim 1, wherein the step of providing a muffler shell comprises providing at least one flat metal sheet comprising the exhaust gas opening, and rolling the at least one flat metal sheet to form the muffler housing or deep drawing the at least one flat metal sheet to form at least one of two muffler shell halves.

9. The method according to claim 1, wherein the step of providing a muffler shell comprises providing two flat metal sheets and deep drawing the two flat metal sheets to form two muffler shell halves and forming the exhaust gas opening during the deep drawing step in at least one of the two muffler shell halves.

10. The method according to claim 1, wherein the step of providing a muffler shell comprises providing at least one flat metal sheet, rolling the at least one flat metal sheet to form the muffler housing or deep drawing the at least one flat metal sheet to form at least one of two muffler shell halves, and subsequent to the rolling or deep drawing step forming the exhaust gas opening.

11. The method according to claim 1, wherein the step of providing a muffler shell comprises providing a muffler shell with an elongated exhaust gas opening adapted to form an outwardly projecting collar having a planar mouth in a direction radial to the rotational axis of the collar forming head.

12. A muffler obtained by the method according to claim 1.

13. A vehicle comprising a muffler according to claim 12.

* * * * *